US006019078A

United States Patent [19]

Kimura et al.

[11] Patent Number: 6,019,078

[45] Date of Patent: Feb. 1, 2000

[54] MANIFOLD FOR OUTBOARD MOTOR

[75] Inventors: Sakayuki Kimura; Takahide Watanabe, both of Hamamatsu, Japan

[73] Assignee: Sanshin Kogyo Kabushiki Kaisha, Hamamatsu, Japan

[21] Appl. No.: 08/997,151

[22] Filed: Dec. 23, 1997

[30] Foreign Application Priority Data

Dec. 25, 1996 [JP] Japan ..... 8-345456

[51] Int. Cl.[7] ..... F02M 35/10

[52] U.S. Cl. ..... 123/184.46; 123/184.21

[58] Field of Search ..... 123/184.21, 184.23, 123/184.32, 184.39, 184.46, 184.59, 184.53

[56] References Cited

U.S. PATENT DOCUMENTS

| | | | |
|---|---|---|---|
| 5,144,918 | 9/1992 | Tanaka et al. | 123/184.42 |
| 5,168,838 | 12/1992 | Seike et al. | 123/184.31 |
| 5,383,440 | 1/1995 | Koishikawa et al. | 123/572 |
| 5,713,771 | 2/1998 | Takahashi et al. . | |
| 5,713,772 | 2/1998 | Takahashi et al. . | |
| 5,743,228 | 4/1998 | Takahashi . | |

*Primary Examiner*—Noah P. Kamen
*Assistant Examiner*—Hai Huynh
*Attorney, Agent, or Firm*—Knobbe, Martens, Olson & Bear LLP

[57] ABSTRACT

An intake manifold for an engine powering a water propulsion device of an outboard motor is disclosed. The engine has first and second combustion chambers and an intake system for delivering a fuel and air charge to each combustion chamber. The intake system includes a first intake passage leading through the engine to the first combustion chamber and a second intake passage leading through the engine to the second combustion chamber, the first intake passage positioned vertically above the second intake passage. The intake manifold is arranged to deliver equal amounts of fuel to the first and second intake passages and includes a main passage extending along a first axis. A first branch defines a passage leading the main passage to the first intake passage, and a second branch defines a passage leading from said main passage to the second intake passage. The main passage divides into the passages defined by the first and second branches at a bifurcation positioned along the axis, the passage of the first branch defined by a first wall part extending in a first direction from the bifurcation and at a first angle with respect to the first axis, and the passage of the second branch defined by a second wall part extending from the bifurcation opposite the axis and at a second angle from the first axis, the second angle exceeding the first angle.

7 Claims, 10 Drawing Sheets

MANIFOLD FOR OUTBOARD MOTOR

FIELD OF THE INVENTION

The present invention relates to an outboard motor. More particularly, the invention relates to an intake manifold for an engine powering an outboard motor.

BACKGROUND OF THE INVENTION

Watercraft are often powered by an outboard motor positioned at a stem of the craft The outboard motor has a powerhead and a water propulsion device, such as a propeller. The powerhead includes a cowling in which is positioned an internal combustion engine, the engine having an output shaft arranged to drive the water propulsion device.

Generally, the motor is connected to the watercraft in a manner which permits the motor to be "trimmed" up and down. For example, the motor may be connected through a horizontally extending pivot pin to a clamping bracket which attaches to the watercraft. In this manner, the motor may be moved in a vertical plane about the axis of the pin. This allows an operator of the watercraft to raise the propeller out of the water of place it deep in the water dependent upon the trim angle of the motor.

In addition, the motor is arranged to turn left and right about a generally vertically extending axis. This arrangement permits the operator of the watercraft to change the propulsion direction of the motor, and thus change the direction in which the watercraft is propelled.

The size of the motor, especially the powerhead portion which includes the motor, effects the air drag associated with the watercraft. It is desirable for the motor to have a small profile to reduce the air drag. In addition, it is generally desirable for the engine to be compact, since this makes the task of trimming and turning the motor less difficult The engine typically is of the internal combustion type with one or a plurality of cylinders. In this type of engine it is desirable that all of the cylinders receive a uniform mixture of air and fuel.

Typically a charge forming device such as a carburetor introduces fuel into air passing through an intake passage. The fuel and air mixture is then routed through individual intake passages leading to each cylinder of the engine. If unequal amounts of fuel are delivered to the cylinders, many problems may result. For example, the engine may not operate smoothly, one cylinder may produce high emissions, and one cylinder may run much hotter than the other making even cooling of the engine difficult.

An example of an intake manifold of the prior art which suffers from unequal fuel distribution is illustrated in FIGS. 10(*a*) and 10(*b*). As illustrated therein, a manifold M includes a main passage P extending from a mounting flange F1. The flange F1 may be connected to a carburetor which introduces fuel into the air passing therethrough. The manifold M branches into a first branch B1 and second branch B2, each branch corresponding to a cylinder of an engine. Each branch B1 ,B2 defines a passage therethrough leading from the main passage P.

As illustrated, the intake for one cylinder is much lower than the other, the second branch B2 slopes downwardly from an axis along which the main passage P and first branch B1 are located. The manifold M is connected to the engine at a second flange F2.

In this arrangement, fuel tends to flow in a larger volume through the branch B2, as the air and fuel mixture which reaches a divider D at the end of the main passage P tends to flow with the air of gravity to this branch B2 defining the lowest point of the manifold M.

In some arrangements, the first branch B1 extends upwardly from the main passage P to the flange F2. In that arrangement, fuel actually drains back in the direction of the second passage B2 further compounding the problem of unequal fuel distribution.

Attempts to solve this problem are compounded by the fact that the intake manifold must not be excessively large or the size of the engine is undesirably increased. Thus, an improved intake manifold which provides for equal fuel distribution, but, without requiring long branch pipes is desired.

SUMMARY OF THE INVENTION

The present invention is an improved intake manifold for an internal combustion engine. Preferably, the engine is positioned in a cowling of an outboard motor and has an output shaft arranged to drive a water propulsion device of the motor.

The engine has first and second combustion chambers and an intake system for delivering a fuel and air charge to each combustion chamber. The intake system includes a first intake passage leading through the engine to the first combustion chamber and a second intake passage leading through the engine to the second combustion chamber, the first intake passage positioned vertically above the second intake passage.

The intake manifold is arranged to deliver equal amounts of fuel to the first and second intake passages and includes a main passage extending along a first axis. A first branch defines a passage leading from the main passage to the first intake passage, and a second branch defines a passage leading from said main passage to the second intake passage. The main passage divides into the passages defined by the first and second branches at a bifurcation positioned along the axis, the passage of the first branch defined by a first wall part extending in a first direction from the bifurcation and at a first angle with respect to the first axis, and the passage of the second branch defined by a second wall part extending from the bifurcation opposite the axis and at a second angle from the first axis, the second angle exceeding the first angle.

Further objects, features, and advantages of the present invention over the prior art will become apparent from the detailed description of the drawings which follows, when considered with the attached figures.

BRIEF DESCRIPTION OF THE DRAWINGS

FIG. 10(*b*) is a cross-sectional view of the prior art manifold illustrated in FIG. 10(*a*) taken along line 10(*b*)—10(*b*) therein.

DETAILED DESCRIPTION OF THE PREFERRED EMBODIMENTS OF THE INVENTION

The present invention is an improved intake manifold arrangement for an engine of the type utilized to power a water propulsion device of an outboard motor and positioned in a cowling of the motor. The engine arranged in accordance with the present invention is described for use with an outboard motor since this is an application for which the engine as arranged has particular utility. Those of skill in the art will appreciate that an engine as arranged in accordance with the present invention may be used in a variety of other applications.

Figure 1:
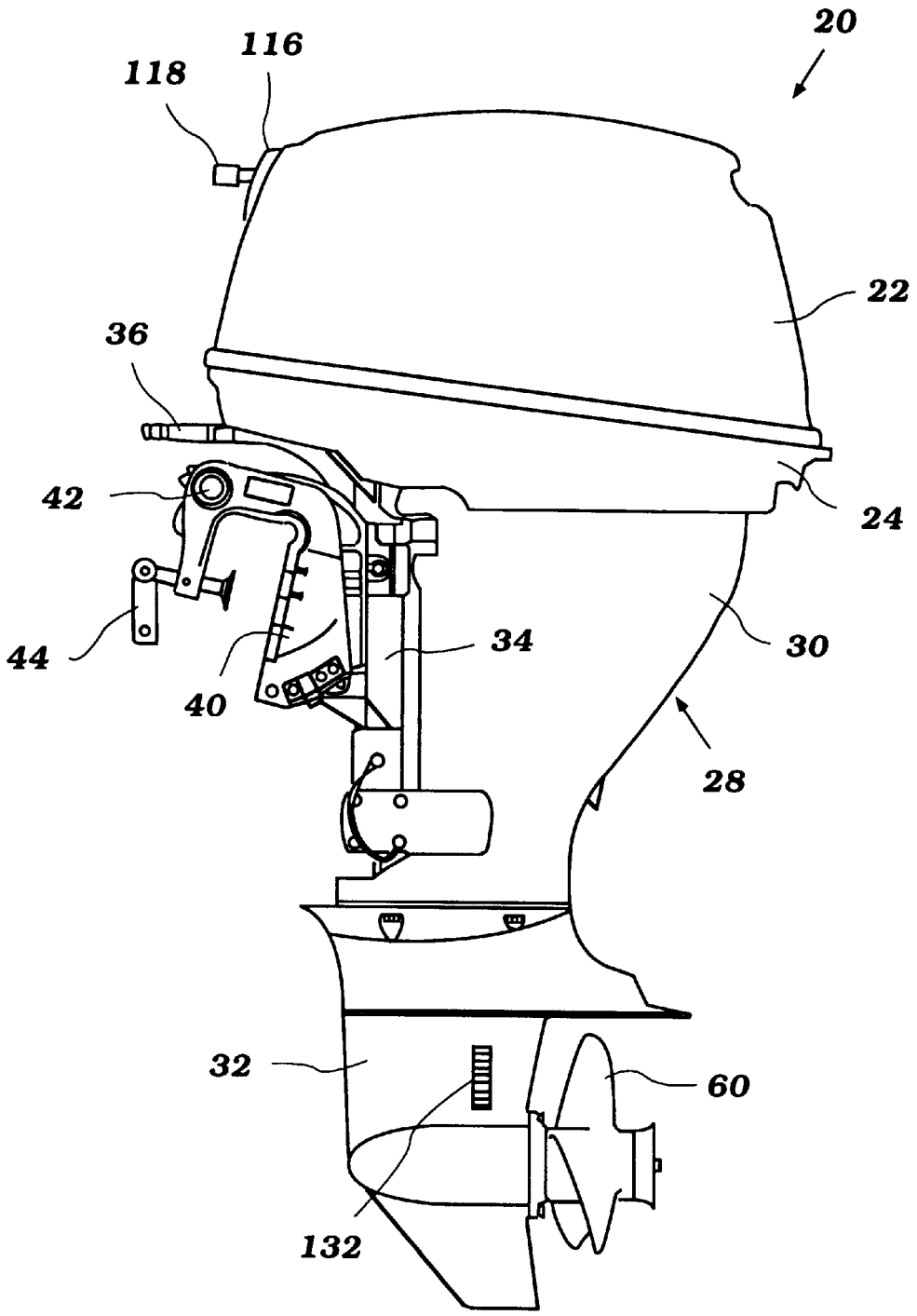
FIG. 1 is a side view of an outboard motor of the type utilized to propel a watercraft, the motor powered by an engine having an intake manifold arranged in accordance with the present invention.
Figure 2:
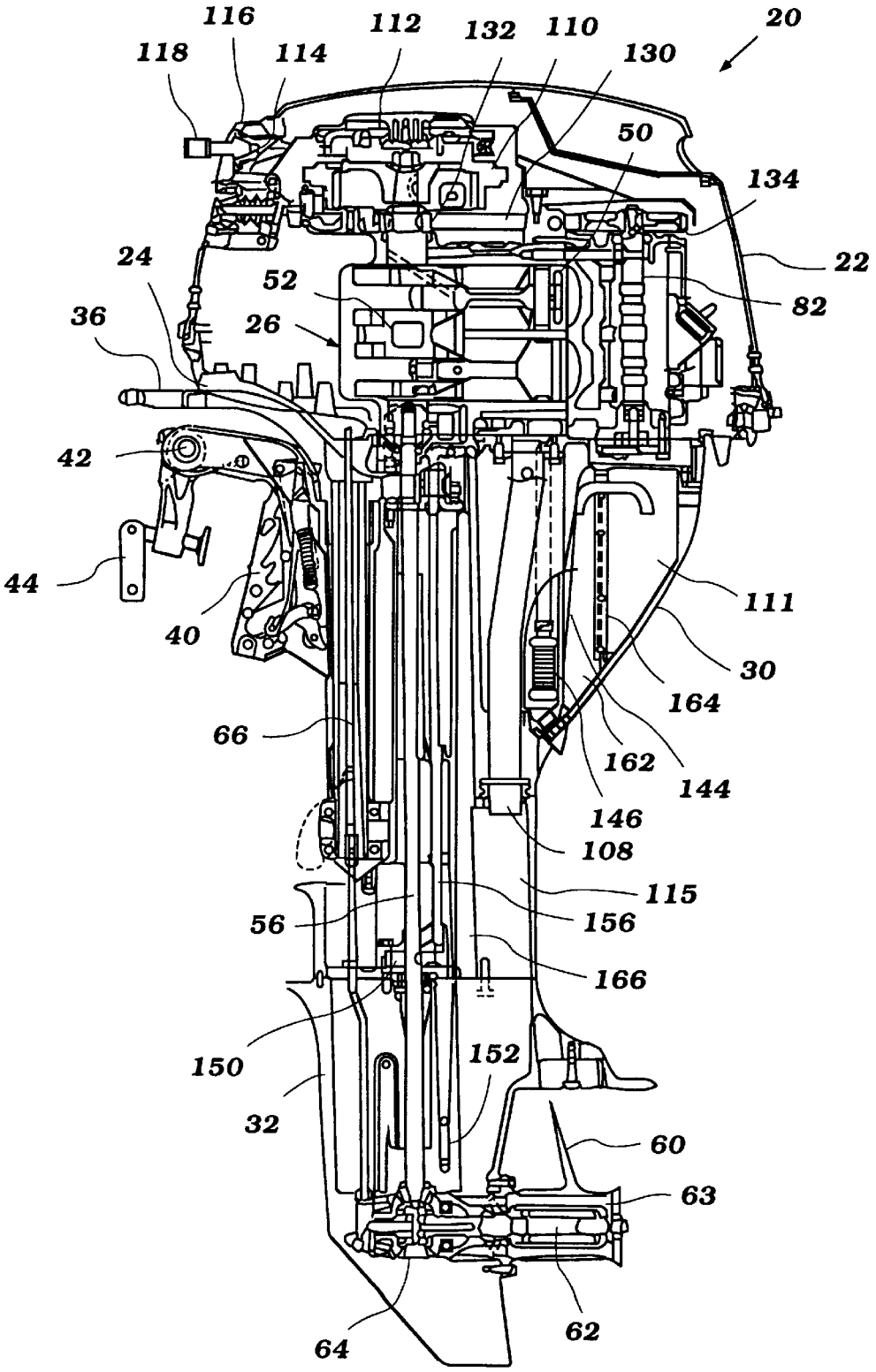
FIG. 2 is a cross-sectional side view of the motor illustrated in FIG. 1.

FIG. 1 illustrates an outboard motor 20 of the type with which the present invention is useful. The outboard motor 20 has a powerhead comprising a main cowling 22 with a lower cowling or tray 24 positioned therebelow. As illustrated in FIG. 2 and described in more detail below, an internal combustion engine 26 is positioned in the powerhead.

A drive shaft housing or lower unit 28 depends below the powerhead. The drive shaft housing 28 comprises an upper casing 30 and a lower unit 32 positioned below the upper casing.

The outboard motor 20 is arranged to be movably connected to a hull of a watercraft (not shown), preferably at a transom portion of the watercraft at a stern thereof. In this regard, a steering shaft (not shown) is connected to the drive shaft housing 28 portion of the motor 20. The steering shaft preferably extends along a vertically extending axis through a swivel bracket 34. The mounting of the steering shaft with respect to the swivel bracket 34 permits rotation of the motor 20 about the vertical axis through the bracket 34, so that the motor may be turned from side to side.

A steering handle or tiller 36 is connected to the bracket 34. An operator of the motor 20 may move the outboard motor 20 from side to side with the tiller 36, thus steering the watercraft to which the motor is connected.

The swivel bracket 34 is connected to a clamping bracket 40 by means of a pivot pin 42 which extends along a generally horizontal axis. The clamping bracket 40 is arranged to be removably connected to the hull of a watercraft with a clamping screw 44 or similar mechanism. The mounting of the motor 20 with respect to the clamping bracket 40 about the pin 42 permits the motor 20 to be raised up and down or "trimmed."

As described above, an engine 26 is positioned in the powerhead. The engine 26 is preferably of the two-cylinder variety, arranged in in-line fashion and operating on a four-cycle principle. As may be appreciated by those skilled in the art, the engine 26 may have a greater or lesser number of cylinders, may be arranged in other than in-line fashion and may operate on other operating principles, such as a two-cycle principle.

Figure 4:
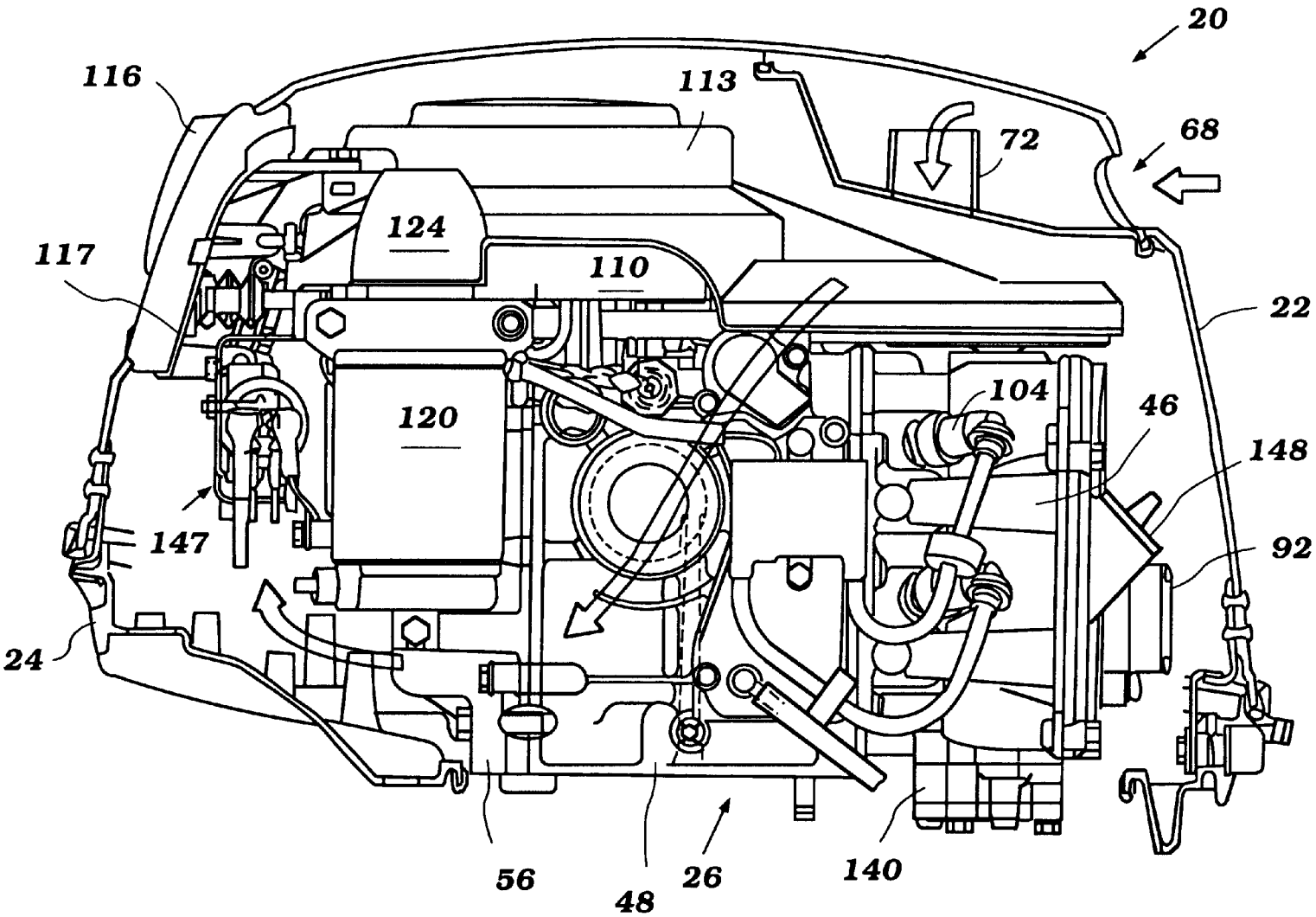
FIG. 4 is an enlarged cross-sectional view of a first side of a top portion of the motor illustrated in FIG. 1.

Referring to FIGS. 2 and 4, the engine 26 preferably comprises a cylinder head 46 connected to a cylinder block 48 and cooperating therewith to define two cylinders. A piston 50 is movably positioned in each cylinder 48 and connected to a crankshaft 52 via a connecting rod 54.

As best illustrated in FIG. 2, the crankshaft 52 is generally vertically extending. As such, the cylinders, and thus the pistons 48, extend in a horizontal direction. The crankshaft 52 is mounted for rotation with respect to the remainder of the engine 26 within a crankcase chamber defined by the cylinder block 48 and a crankcase cover 56 connected thereto. As illustrated, the crankcase cover 56 is positioned at the opposite end of the cylinder block 48 from the cylinder head 46. Preferably, the cylinder head end of the engine 26 is positioned within the main cowling 22 farthest from a watercraft when the motor 20 is attached thereto, and the crankcase end of the engine 26 is thus closest to a watercraft when the motor 20 is attached thereto.

The crankshaft 52 extends below a bottom of the engine 26 in the direction of the drive shaft housing 28, where it is coupled to a drive shaft 58. The drive shaft 58 extends through the drive shaft housing 28 and is arranged to drive a water propulsion device of the motor 20. As illustrated, the water propulsion device is a propeller 60.

In the preferred arrangement, the drive shaft 58 is arranged to selectively drive a propeller shaft 62 through a forward-neutral-reverse transmission 64. The propeller 60 is connected to an end of the propeller shaft 62 opposite the transmission 64. Preferably, the position of the transmission 64 is controlled by a shift rod 66 extending through the drive shaft housing 28 to the transmission 64 from a transmission, control (not shown) which the operator of the motor 20 manipulates.

An intake system provides air to each cylinder of the engine 26 for the combustion process. As illustrated in FIG. 4, air is drawn through a vent 68 in the main cowling 24 into an inlet area 70 formed by the main cowling 24. Air then flows through an upwardly extending air inlet pipe 72 into the interior of the cowling in which the engine 26 is positioned. The above-described arrangement serves to reduce the flow of water and the like through the vent 68 into the portion of the cowling 22 which houses the engine 26. In the preferred embodiment, a similar intake pipe 73 leads from the inlet area 70 into the engine compartment on the opposite side of the cowling 22 (see FIG. 3).

Figure 3:
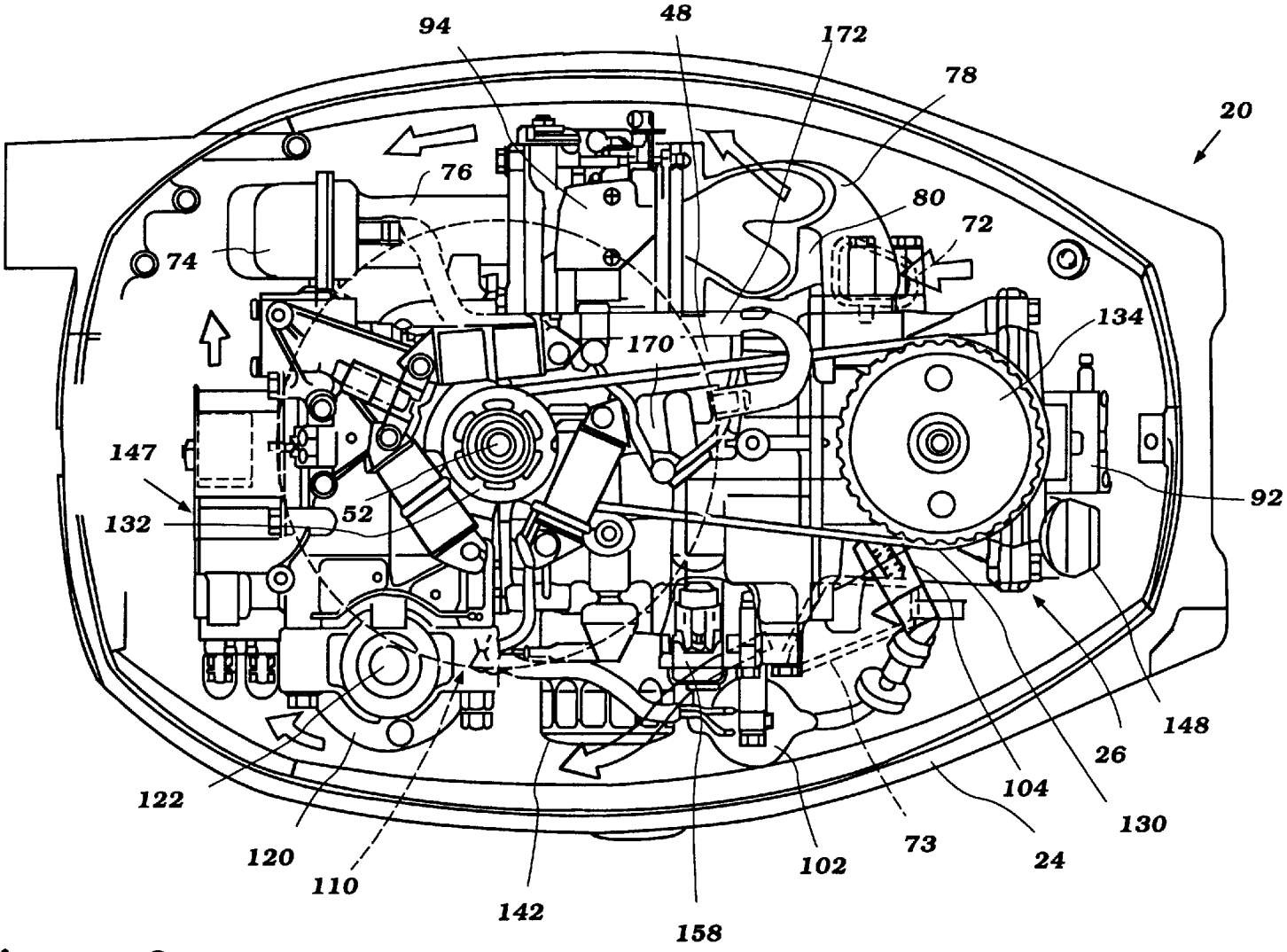
FIG. 3 is a top view of the motor illustrated in FIG. 1 with a main cowling and a flywheel cover removed, exposing a top end of the engine.
Figure 5:
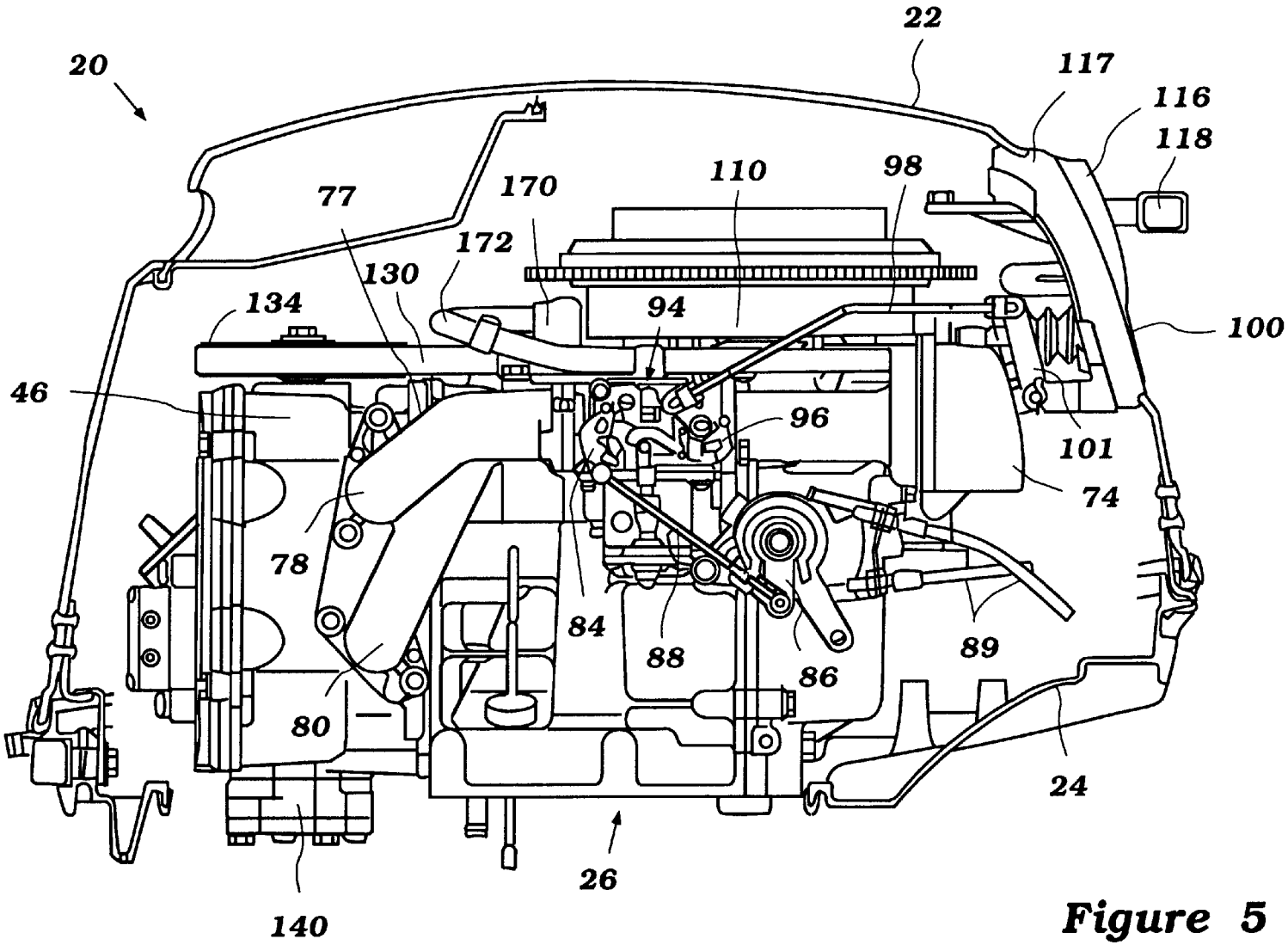
FIG. 5 is an enlarged cross-sectional view of a second side of a top portion of the motor illustrated in FIG. 1 and with a flywheel cover of the engine removed.
Figure 7:
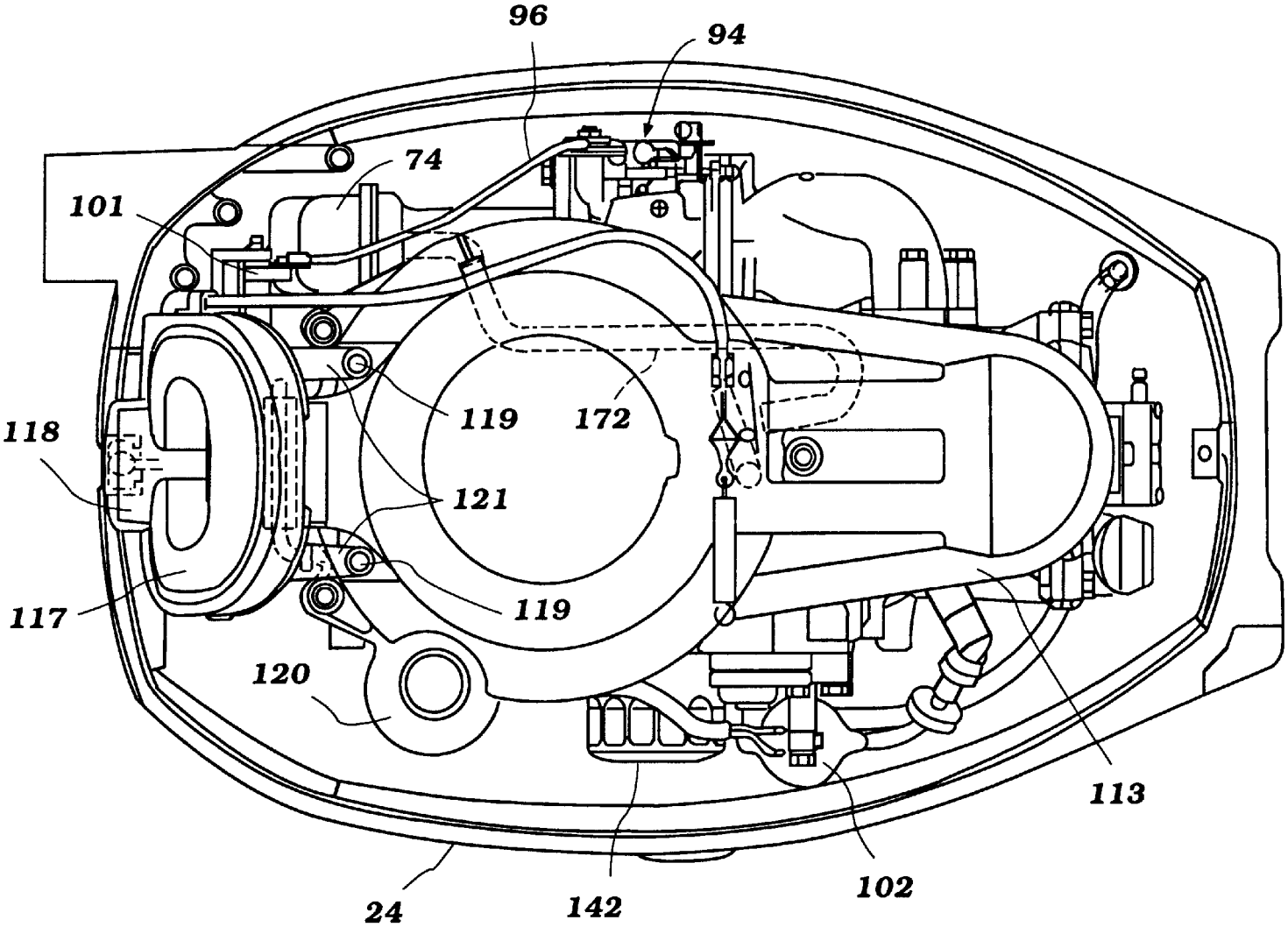
FIG. 7 is a top view of the motor illustrated in FIG. 1, with a portion of a main cowling removed, exposing the engine therein.

Referring now to FIGS. 3, 5 and 7, air within the main cowling 22 is drawn into a silencer 74. The air is then drawn from the silencer 74 through an intake pipe 76 to an intake manifold 77 having a pair of branch pipes 78, 80. The branch pipes 78, 80 are connected to the cylinder head 46 of the engine 26 and each have a passage therethrough aligned with a corresponding passage through the cylinder head 46 leading to one of the cylinders. In this manner, air flows through the intake pipe 76 and respective branch pipes 78,80 to each cylinder. The intake manifold 77 will be described in more detail below.

In the embodiment illustrated, the intake pipe 76 and manifold 77 preferably extend along a first side of the engine 26 from the crankcase chamber end towards the cylinder head end, generally below a top of the engine.

Preferably, means are provided for controlling the flow of air into each cylinder in a timed manner. Though not illustrated, this means may comprise an intake valve positioned in each intake passage leading through the cylinder head 46 to a cylinder. In such an arrangement, each intake valve is preferably actuated between open and closed positions, as known to those of skill in the art, by at least one camshaft 82 (see FIG. 1).

Means are also provided for controlling the rate of air flow through the intake system to each cylinder. Preferably, this means comprises a throttle valve (not shown) positioned in the intake pipe 76. Referring to FIG. 5, the throttle valve is preferably actuated by a throttle lever 84. This lever 84 is connected to a pivot lever 86 via a throttle link 88. A throttle actuator wire 89 is connected to the pivot lever 86 for moving the pivot lever 86, the wire 89 extending to an operator-engaged throttle control (not shown) as known to those skilled in the art.

A fuel system provides fuel to each cylinder for combustion with the air. The fuel system draws fuel from a fuel supply (not shown) such as a fuel tank positioned in the hull of the watercraft to which the motor 20 is connected. Preferably, as illustrated in FIG. 4, the fuel is drawn by a fuel pump 92. The fuel pump 92 delivers the fuel through a fuel line to a charge former. In the preferred embodiment, the charge former comprises a carburetor 94.

As illustrated, the carburetor 94 is positioned along the intake pipe 76 for introducing fuel into the air passing therethrough. In this manner, a combined air and fuel charge is delivered through the branch pipes 78,80 to the cylinders. Though not described herein, those of skill in the art will appreciate that other charge formers such as fuel injectors may be used. In addition, a carburetor may be provided corresponding to an intake pipe leading to each cylinder instead of a single carburetor for all cylinders as in the illustrated embodiment The carburetor 94 is preferably arranged so that the movement of the throttle lever 84 effectuates a change in the rate of air and fuel delivery, as is known to those of skill in the art A choke lever 96 is also associated with the carburetor 94 and controls the position of a choke valve (not shown) which is movably positioned in the intake pipe 76. The choke lever 96 is actuated through a choke link 98 from a choke knob 100. Preferably, the knob 100 is positioned externally to the main cowling 22 at the end of the motor 20 which is closest the watercraft for engagement by an operator of the watercraft. More particularly, the knob 100 is mounted to the combination guide and mount 116 connected to the cowling 22.

Referring to FIG. 5, an offset linkage mechanism 101 is provided between a rod which is associated with the knob 100 and the link 98 for transmitting a force applied to the knob 100 to the link 98 for actuating the choke valve.

The engine 26 includes an ignition system. Such systems are well known to those of skill in the art, and thus the system is not described in detail herein. Preferably, however, the system includes a powered ignition coil 102 which delivers a charge at a predetermined time to a spark plug 104 corresponding to each cylinder as illustrated in FIG. 3. Each spark plug 104 has its tip positioned in the cylinder, and when the charge is delivered to the spark plug, effects a spark across an electrode tip thereof to initiate the combustion of the air and fuel mixture in the cylinder.

In the embodiment illustrated, the ignition coil 102 has a pair of mounting parts 103 extending from a housing thereof. The mounting parts 103 are connected to a pair of bosses 105 extending from a cover element 107. As described in more detail below, the cover element 107 defines a coolant passage 158 through which coolant flows for cooling a portion of an exhaust system. Preferably, a bolt 109 engages each mounting part 103 of the coil 102 and a corresponding boss 105.

Referring to FIGS. 2 and 3, an exhaust system is provided for routing exhaust from each cylinder. Preferably, an exhaust passage (not shown) leads through the cylinder head 46 from each cylinder. Each passage leads to a passage through an exhaust manifold 106 connected to the cylinder head 46. Preferably, the manifold 106 is arranged to route exhaust gases to an exhaust pipe 108 which extends below the engine 26 into the drive shaft housing 28. The exhaust pipe 108 terminates in a first expansion chamber or muffler 115. When the engine speed is low and the exhaust back-pressure is low, the exhaust is preferably routed to a second expansion chamber 111 and then through an above the water exhaust gas discharge. When the engine speed is higher and the exhaust pressure is high, the exhaust is preferably routed from the expansion chamber 115 through a through-the-hub (of the propeller) discharge 63 into the body of water in which the motor 20 is operating.

As with the intake system, valve means are preferably provided corresponding to each cylinder for controlling the flow of exhaust therefrom. Although not illustrated, these means may comprise an exhaust valve associated with each cylinder and movable between one position in which exhaust is permitted to flow through the exhaust passage therefrom, and a second position in which the exhaust is not permitted to flow from the cylinder. The same camshaft 52 which is used to control the intake valves may be used to control the exhaust valves. Alternatively, and as known to those of skill in the art, a separate exhaust camshaft may be provided for actuating only the exhaust valves.

A starter mechanism is provided for use in starting the engine 26. Referring to FIGS. 2 and 4, the starter mechanism preferably includes a recoil type starter. In this arrangement, the crankshaft 52 extends above a top end of the engine 26. A flywheel 110 having a number of teeth 111 spaced about a peripheral edge is connected to the portion of the crankshaft 52 extending above the engine 26.

A recoil starter mechanism 112 of a type known to those of skill in the art is preferably associated with the flywheel 110. The recoil starter mechanism 112 is positioned above the flywheel 110, but under a starter mechanism/flywheel cover 113.

A starter cord 114 extends from the recoil mechanism through a combination cord guide and mounting 116 extends through the main cowling 22. A seal 117 is preferably provided between the cord guide 116 and the cowling 22 for providing an air and water tight seal therebetween.

A handle 118 is connected to the end of the cord 114 which extends through the guide 116. In this arrangement, when the operator of the watercraft pulls on the handle 118 and extends the cord 114, the flywheel 110 is rotated, starting the engine 26.

When this type of starting mechanism is employed, the ignition system preferably includes a magneto-type generator which generates power for powering the ignition coil 102 without the need for a battery.

As best illustrated in FIG. 7, the combination guide and mount 116 and recoil mechanism cover 113 are connected securely to one another through a pair of bolts 119. The bolts 119 extend through a pair of spaced flanges 121 extending from the guide 116 towards the cover 113, and into the cover 113 itself.

The motor 20 may also be provided with an electrically powered starter motor 120 for those instances where a battery is available. Referring to FIGS. 3 and 4, the starter motor 120 is preferably mounted along a side of the engine 26 with a pinion gear 122 arranged to drive the teeth 111 of the flywheel 110. A cover 124 is mounted over the pinion gear 122.

The motor 120 is preferably mounted to several mounting flanges or bosses 121 extending from the crankcase cover 56, as best illustrated in FIGS. 3 and 4. The motor 120 5 includes one or more corresponding mounting areas. In the embodiment illustrated, a bolt 123 engages each mounting area of the starter motor 120 and a corresponding boss 121. Of course, the starter motor 120 may be mounted in a variety of other manners as appreciated by those of skill in the art.

Figure 6:
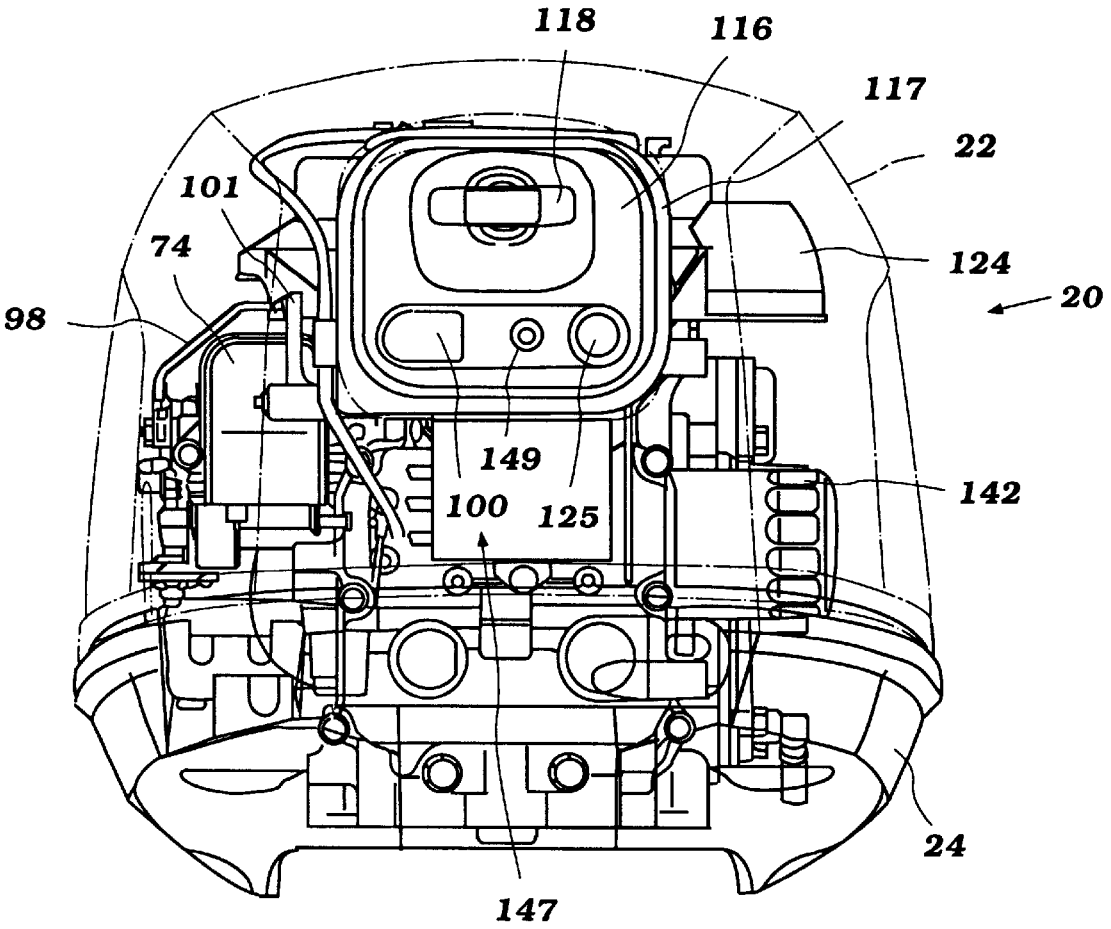
FIG. 6 is an end view of the engine powering the motor illustrated in FIG. 1, with a portion of the cowling enclosing the engine illustrated in phantom.

When an electric starter 120 is provided, a starter button 125 is preferably mounted to the mount 116 on the exterior of the main cowling 22, near the choke button 100 as illustrated in FIG. 6.

Means are provided for driving the camshaft 82. As illustrated in FIG. 2, the camshaft 82 is preferably driven by the crankshaft 52 by means of a flexible transmitter such as a chain or belt 130. A drive pulley 132 is connected to the portion of the crankshaft 52 which extends above the top end of the engine 26. Preferably, the drive pulley 132 is mounted below the flywheel 110. A driven pulley 134 is connected to an end of the camshaft 82 also extending above the top end of the engine. The drive belt 130 extends in engagement with the two pulleys 132,134, whereby rotation of the crankshaft 52 effectuates rotation of the camshaft 82.

The motor 20 includes a number of sub-systems relating to the engine 26. First, a lubricating system provides lubricant to one or more parts of the engine 26 for lubricating them. The lubricating system includes means for drawing lubricant from a lubricant supply and delivering it to the engine 26. In the embodiment illustrated, the supply is located in an oil pan 144 positioned below the engine 26 in the drive shaft housing 28.

Preferably, the means for delivering lubricant comprises an oil pump 140. Referring to FIGS. 4 and 5, the lubricant pump 140 is positioned below the engine 26 and is preferably driven by an end of the camshaft 82 extending below the engine. The pump 140 draws lubricant upwardly towards the engine 26 through a filtered inlet 146 positioned in the oil pan 144.

The pump 140 delivers lubricant from the supply through a filter 142. The lubricant then flows through one or more passages or galleries through the engine 26 for lubricating the various parts thereof, as well known to those of skill in the art. The lubricant preferably drains downwardly through one or more drain passages to the lubricant or oil pan 144 for re-delivery to the engine.

Referring to FIG. 3, an oil fill port 148 is preferably provided at the end of the engine 26 where the cylinder head 46 is positioned. The oil fill portion 148 is provided in communication with the oil pan 144 through the drain lines, whereby an operator of the motor 20 may add lubricant to the lubricating system.

The lubricating system includes means for providing a warning of a lubricant system malfunction or undesirable condition. Referring to FIG. 6, a lubricant system warning lamp 149 is preferably provided on the mounting part 117 adjacent the choke knob 100. The lamp 149 may be arranged to illuminate when a lubricant sensor indicates that the lubricant level in the pan 144 is low, or the lubricant pressure in the lubricant system is too low or too high, or when other similar undesirable lubricating system conditions arise as known to those of skill in the art.

This warning system may include electronics 147 which are mounted at the crankcase end of the engine 26 adjacent the starter motor 120 as illustrated in FIG. 4. These electronics 147 may also include other electrical system components such as relays and the like which comprise portions of the starting, ignition or other systems.

A cooling system is provided for cooling one or more parts of the engine 26. The cooling system includes means for delivering coolant to the engine 26. Referring to FIG. 2, this means preferably comprises a coolant pump 150. The coolant pump 150 is positioned in the drive shaft housing 28 and driven by the drive shaft 58.

The coolant pump 150 draws water from the body of water in which the motor 20 is operating through an inlet 152 in the lower case 32 of the drive shaft housing 28. This coolant is delivered upwardly through the drive shaft housing 28 to the engine 26 through a coolant delivery line 156.

The coolant is delivered through one or more coolant passages or jackets, such as passages in the cylinder head 46 and block 48 and the passage 158 arranged to cool a portion of the exhaust system, for cooling various parts of the engine 26. The coolant preferably drains through a drain line from the engine 26 into a coolant pool 162 located in the drive shaft housing 28. The coolant pool 162 is preferably positioned adjacent the oil pan 144 and separated from the second expansion chamber 111 by a dividing wall.

The coolant drains from the pool 162 (such as over an overflow weir, not shown) through a drain passage 166 to a discharge through the drive shaft housing 28 back to the body of water in which the motor 20 is operating.

The cooling system may be provided with one or more thermostats (not shown) as known to those of skill in the art for use in controlling the flow of coolant through the engine 26. For example, a thermostat may be provided for limiting the flow of coolant through the engine 26 when the engine temperature is low, permitting the engine 26 to warm up.

The cooling system may also include a pressure relief valve (not shown) for diverting coolant from the cooling system in the event the pressure in the system exceeds a predetermined high pressure.

Referring to FIGS. 3 and 5, the engine 26 includes a crankcase pressure relief system. This system includes a crankcase breather element 170 which is connected to the crankcase cover 56. The element 170 has a passage therethrough which is in communication with the crankcase chamber and a by-pass or breather line 172 leading to the intake system. The element 170 is preferably positioned at the top end of the engine 26 adjacent the flywheel 110, as best illustrated in FIG. 3.

Figure 8:
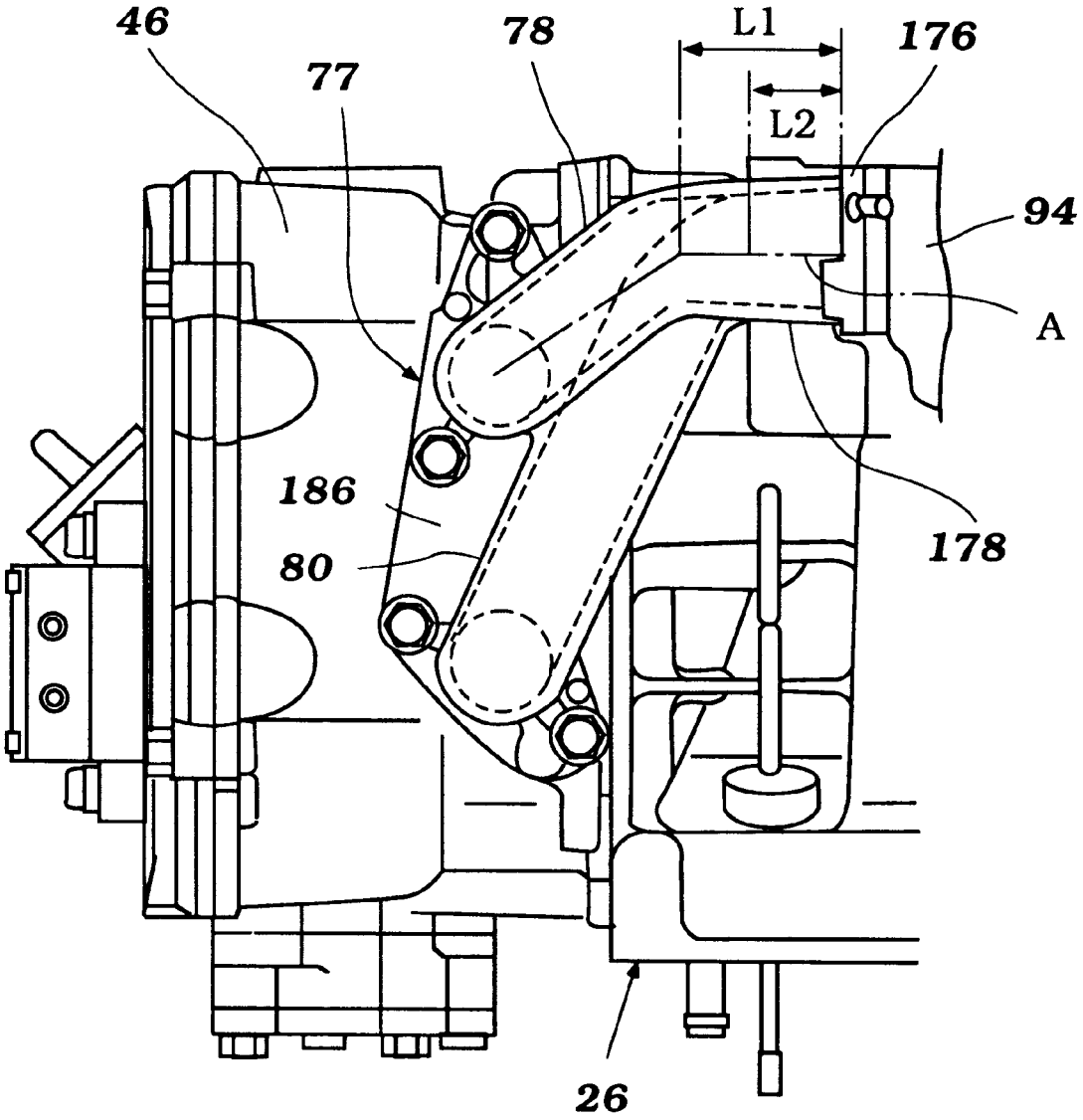
FIG. 8 is a side view of a portion of the engine illustrated in FIG. 5, illustrating the intake manifold of the present invention.
Figure 9:
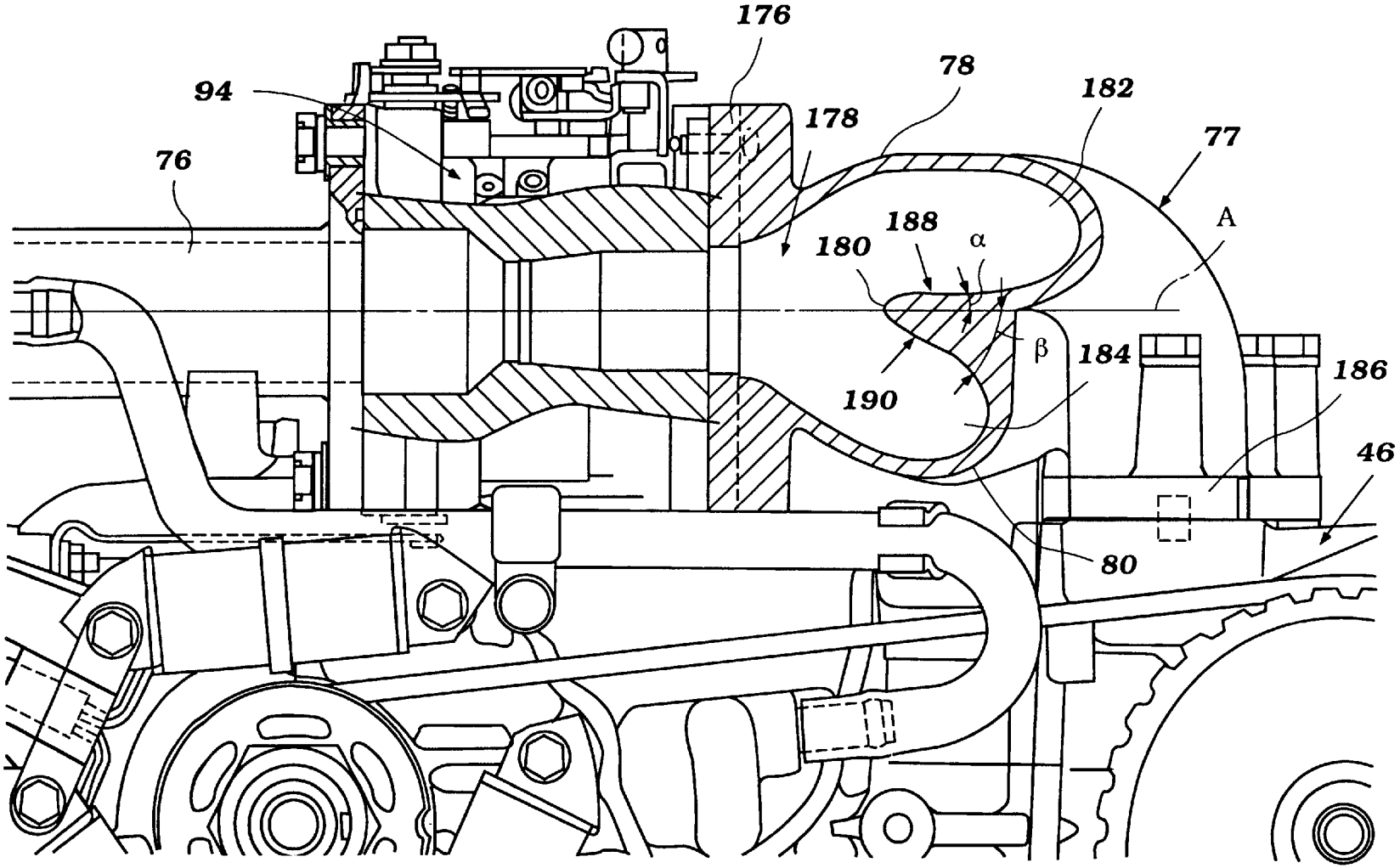
FIG. 9 is a top view of a portion of the engine illustrated in FIG. 3, with the intake manifold illustrated in cross-section.
Figure 10A:
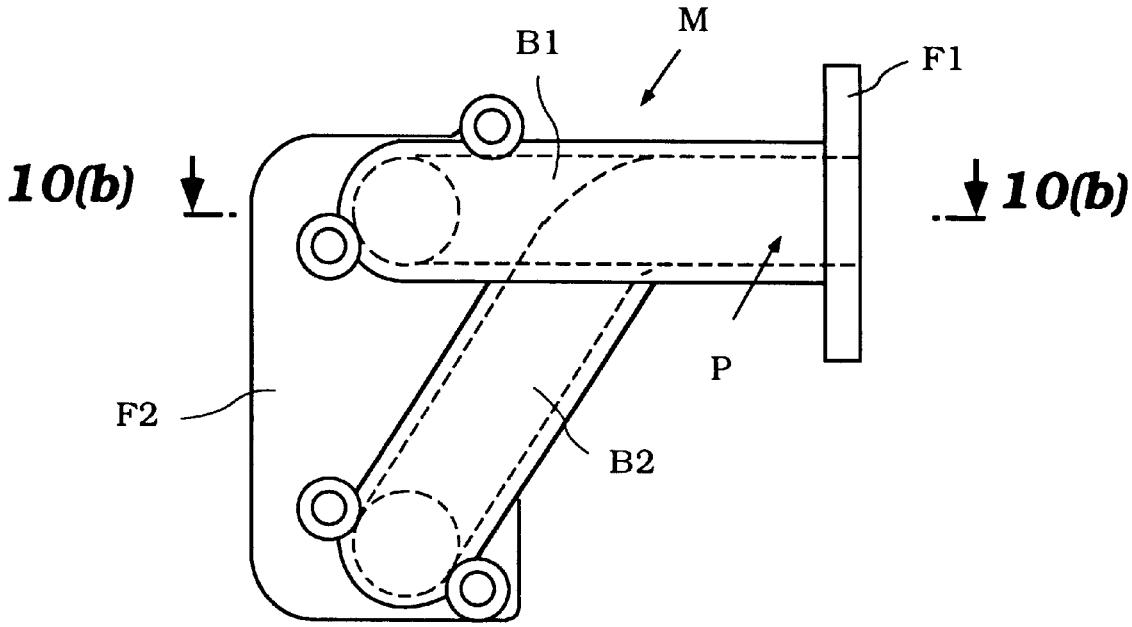
FIG. 10(*a*) is a side view of an intake manifold in accordance with the prior art.
Figure 10B:
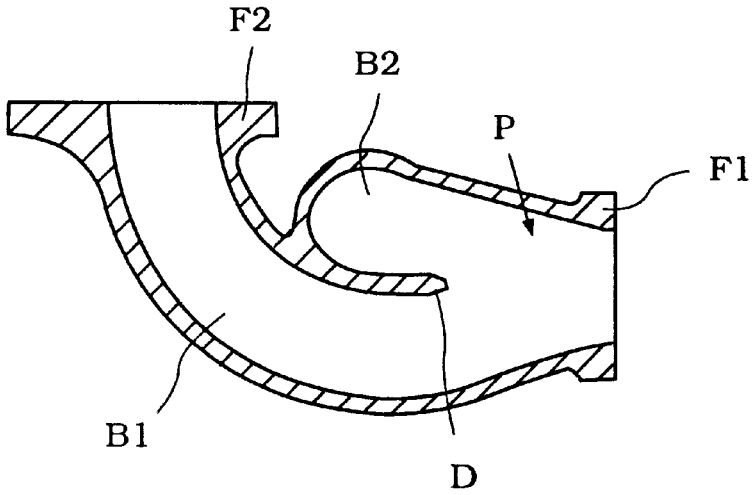

The improved intake manifold 77 of the present invention is best illustrated in FIGS. 8 and 9. As illustrated, the manifold 77 has a first mounting flange 176 which connects the manifold to the carburetor 94. A main part of the manifold 77 extends from the first flange 176, this part of the manifold 77 defining a single passage 178 which aligns with the passage through the carburetor 94.

At a dividing wall or bifurcation 180, the single passage 178 divides into a first passage 182 defined by the first branch 78, and a second passage 184 defined by the second branch 80. The branches 78,80 terminate at a second mounting flange 186 which connects to the cylinder head 46.

As illustrated in FIG. 8, both the first and second branches 78,80 slope downwardly from an axis A which extends through the passage through the carburetor 94 and the main passage 178 of the manifold 77. Preferably, the passage 182, within the first branch 78, does not bend downwardly until a distance L1 from the flange 176 along this axis A. The passage 184, through the second branch 80, bends downwardly at a distance L2 along the axis A from the flange 176. The distance L1 exceeds L2.

As illustrated in FIG. 9, the passage 182 through the first branch 78 is defined at the bifurcation 180 in part by a wall 188. This wall 188 extends at an angle α from the bifurcation 180 with respect to the axis A (in a direction away from the engine). The passage 184 through the second branch 80 is defined at the bifurcation 180 in part by a wall 190. This wall 190 extends at an angle β from the bifurcation 180 with respect to the axis A (and in a direction towards the engine). The angle β exceeds the angle α.

In the arrangement described, a fuel and air mixture is delivered to the main passage 178 of the manifold. This mixture is divided, with relatively equal amounts of fuel flowing through each branch 78,80 to a respective cylinder. This is accomplished by the arrangement described, in which both branches 78,80 bend downwardly so that gravity aids the flow of fuel through each branch. To compensate for the greater drop in distance of the second branch 80, the angle β of the inlet to the passage 184 through the second branch 80 is greater that of the first branch 78. In addition, the flow path from the main passage 178 along the first branch 78 is straighter for a longer distance L1 than that of the second branch 80. The lesser angle of entry α coupled with the straighter pathway of the first branch 78 offsets the effect of the increased vertical drop of the second branch 80, whereby a relatively even fuel flow is obtained therebetween.

At the same time, the lengths of the branches 78,80 and the overall size of the manifold 77 is kept small. Thus, the engine 26 and its related components have a compact layout. This permits the overall size of the powerhead of the motor 20 to be small. The small powerhead reduces the air drag associated with the motor 20 and makes less difficult the task of trimming and turning the motor.

Of course, the foregoing description is that of preferred embodiments of the invention, and various changes and modifications may be made without departing from the spirit and scope of the invention, as defined by the appended claim.

What is claimed is:

1. An outboard motor having a cowling and a water propulsion device, an internal combustion engine positioned in said cowling and arranged to propel said water propulsion device, said engine having a first and a second combustion chamber, said engine having an intake system for delivering a fuel and air charge to each combustion chamber, said intake system including a first intake passage leading through said engine to a first combustion chamber and a second intake passage leading through said engine to said second combustion chamber, said first intake passage positioned vertically above said second intake passage, and an intake manifold delivering said air and fuel mixture to said first and second intake passages, said intake manifold defining a main passage extending along a first axis, a first branch defining a passage leading from said main passage to said first intake passage, and a second branch defining a passage leading from said main passage to said second intake passage, said main passage dividing into said passages defined by said first and second branches at a bifurcation positioned along said axis, said passage of said first branch defined by a first wall part extending in a first direction from said bifurcation and at a first angle with respect to said first axis, and said passage of said second branch defined by a second wall part formed integrally with said first wall portion at said bifurcation and extending from said bifurcation opposite said axis and at a second angle from said first axis, said second angle exceeding said first angle.

2. The outboard motor in accordance with claim 1, wherein said passage defined by said second branch extends in a direction towards said engine from said first axis, and said passage defined by said first branch extends in a direction away from said engine from said first axis.

3. The outboard motor in accordance with claim 1, wherein said passage defined by said first branch has a portion that extends parallel to said first axis from said main passage and said second branch diverges from said first axis in the area of said first branch portion.

4. The outboard motor in accordance with claim 3, wherein said second branch diverges downwardly from at an angle with respect to said first axis.

5. The outboard motor in accordance with claim 4, wherein said first branch diverges downwardly from said first axis downstream of said first branch portion and second branch extends downwardly from said first axis at an angle which exceeds an angle at which said first branch extends downwardly from said first axis.

6. The outboard motor in accordance with claim 1, wherein said engine includes a carburetor and said manifold includes a flange at an end of said manifold defining said main passage and said flange is removably attached to said carburetor.

7. The outboard motor in accordance with claim 1, wherein said first axis is generally horizontal.

* * * * *

UNITED STATES PATENT AND TRADEMARK OFFICE

CERTIFICATE OF CORRECTION

PATENT NO. : 6,019,078
DATED : February 1, 2000
INVENTOR(S) : Kimura et al.

It is certified that error appears in the above-identified patent and that said Letters Patent is hereby corrected as shown below:

Column 10,
Line 34, "from at an angle with" should be -- from said main passage at an angle with --.

Signed and Sealed this

Twenty-ninth Day of June, 2004

JON W. DUDAS
*Acting Director of the United States Patent and Trademark Office*